United States Patent [19]

Ljungberg

[11] 4,040,329

[45] Aug. 9, 1977

[54] METHOD AND ARRANGEMENT FOR CHARGING OF SHOTHOLES

[75] Inventor: Sten Herman Ljungberg, Stockholm, Sweden

[73] Assignee: Nitro Nobel AB, Gyttorp, Sweden

[21] Appl. No.: 694,100

[22] Filed: June 7, 1976

[30] Foreign Application Priority Data

June 9, 1975 Sweden ..... 7506593

[51] Int. Cl.[2] ..... F42B 3/00; F42D 1/08

[52] U.S. Cl. ..... 86/20 C; 102/22 R; 102/28 P; 175/1

[58] Field of Search ..... 86/20 C; 102/22 R, 23, 102/24 R, 28 P; 181/116; 175/1

[56] References Cited

U.S. PATENT DOCUMENTS

| | | | |
|---|---|---|---|
| 1,698,962 | 1/1929 | Olin et al. | 102/28 P |
| 2,123,996 | 7/1938 | Hunt | 102/28 P |
| 2,614,804 | 10/1952 | Carlisle | 181/116 X |
| 2,755,878 | 7/1956 | Smith | 181/116 |
| 2,773,669 | 12/1956 | Norman et al. | 175/1 |
| 3,104,584 | 9/1963 | Jacobs | 86/20 C |
| 3,323,611 | 6/1967 | Blayney | 181/116 |
| 3,721,471 | 3/1973 | Bergmann et al. | 102/23 X |

FOREIGN PATENT DOCUMENTS

| | | | |
|---|---|---|---|
| 2,352,896 | 5/1975 | Germany | 102/28 P |

*Primary Examiner*—David H. Brown
*Attorney, Agent, or Firm*—Shlesinger, Fitzsimmons & Shlesinger

[57] ABSTRACT

A detonator is positioned in the bore of, or adjacent to, a roll or coil of detonating cord, one end of which is attached to the detonator, which in turn is aligned with a shothole and with a flexible, tubular inserting device, which advances over one end of the detonator and forces it into the shothole, during which operation the cord unwinds and is drawn into the shothole at the outside of the tubular inserter. In one embodiment cylindrically-shaped coils of cord containing the detonators are fed, as needed, through a supply tube to a receptacle positioned in front of the shothole and in front of the forward end of the inserter. In another embodiment both primer caps and detonators, with cord attached, are rotatably indexible into registry with the inserting tube and a shothole.

5 Claims, 9 Drawing Figures

METHOD AND ARRANGEMENT FOR CHARGING OF SHOTHOLES

When charging shotholes in rock or similar material, it is known to introduce explosives in the form of cartridges or powder by means of a charging machine, so that this phase of blasting work is mechanized and can be executed at a rapid pace. Further, when charging shotholes, detonators must be introduced into the shotholes—an operation which hitherto has always been performed manually by inserting a detonator to the bottom of each hole while at the same time unwinding from a coil beside the charger, the cord which is connected to the detonator for the purpose of firing the latter.

The purpose of this invention is to improve the shothole charging procedure with regard to the introduction of the detonator, so that this operation is also performed mechanically as the explosive is introduced. The invention is thus characterized by the fact that the detonator is inserted toward the bottom of the shothole ahead of the explosive, simultaneously with and by the action of a tube element, which serves to insert the explosive and acts in conjunction with machine-driven devices, while a cord connected to the detonator is unwound from a coil at the mouth of the hole.

An arrangement specially suited for placing this method into practice involves the introduction of a charging tube into the shothole by means of motor-driven devices supported on a stand, and is characterized by the presence on the stand of a retainer situated ahead of the end of the tube and serving to guide a roll of cord which is combined with a detonator in such a way that the latter is positioned in the path of the tube and is therefore propelled by the tube as the latter is introduced into the shothole, at the same time as cord is unwound.

The invention will be described in more detail below with reference to the forms of execution shown as examples on the attached drawings. In the course of the description, other characteristic features of the invention will be mentioned.

Equivalent parts have been assigned the same numbers in all figures.

Figure 1:
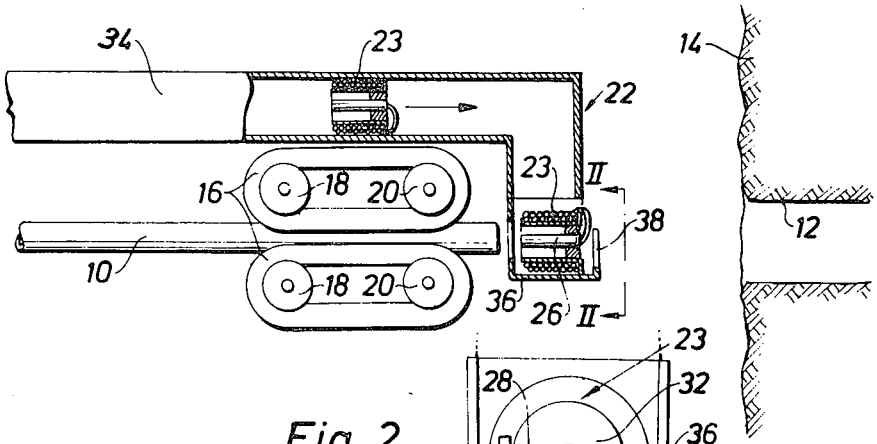
FIG. 1 is a fragmentary side view of a charging unit suitable for performing the method in accordance with one embodiment of the invention, the unit being shown positioned in front of a shothole.

A charging tube 10 is positioned as in FIG. 1 opposite the center of a shothole 12 which has been drilled out in a rock body 14 and which is to be charged with explosive and a detonator. The tube should preferably be made of a flexible material such as rubber or plastic and serves to introduce the explosive into the shothole. For this purpose the other end of the tube is provided in a well known manner with devices (not shown) for the feeding into the tube of explosive in the form of cartridges or powder and the conveyance of the explosive through the tube, preferably by means of a gaseous pressure medium such as compressed air. The tube is inserted into the hole by mechanically driven or motor-driven devices which in FIG. 1 take the form of two counterposed endless rubber belts 16 mounted on tensioning and driving pulleys 18, 20. The motor, which is not shown, may be of hydraulic or compressed air type.

The driving elements are mounted on a stand, as will be more closely described below, and the stand supports a feed-in device 22 (FIG. 1) for assemblies 23 of cords and detonators. Each such assembly consists of a roll or coil 24 of cord 25 and a detonator 26 which is united with the end portion 28 of the cord. In this embodiment the cord is wound in an elongated cylindrical shape, in which case the coils may be wound around a tubular core 30, although this is not essential. The detonator 26 is positioned in the center of the roll by means of a guide 32. In mounting position the free end of the detonator points toward the tube, as shown in the figures.

The feed-in device 22 has a duct 34 for automatically conveying the assemblies 23 from a magazine (not shown). The assemblies are deposited one at a time in a retainer 36 which is situated directly ahead of the tube 10 and which guides the assembly so that the detonator 26 is centrally positioned in the path of the tube 10. The retainer 36 has a steering arm or finger 38 which ensures that the roll of cord 24 rotates around its own axis as it is unwound.

Figure 3:
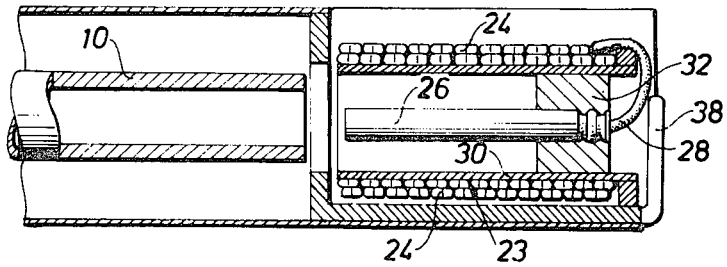
FIG. 3 is an enlarged, fragmentary sectional view showing the front part of the unit in its initial position.
Figure 4:
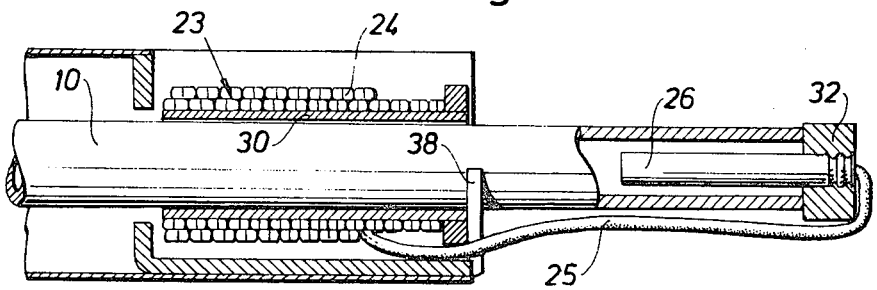
FIG. 4 is a sectional view similar to FIG. 3 but showing the same front part after introduction of the detonator into the shothole has commenced.

When from its initial position as per FIG. 3 the tube 10 is introduced into the shothole 12 it strikes the guide 32 and propels the latter and the detonator before itself as shown in FIG. 4. The cord 25 remains rolled up in the retainer 36 and is unwound turn by turn as the roll rotates round the tube 10. In this way the cord is prevented from becoming twisted as it unwinds. The cord 25 may be of metal wire if the detonator is a hot wire fuse lighter. However, it may also be of the fuse type, consisting, for example, of a thin plastic tube provided with, for example, a thin layer of explosive as described in Swedish Pat. NO. 332,321.

Figure 2:
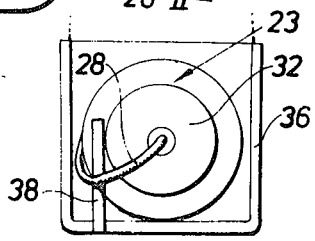
FIG. 2 is a fragmentary end view of this unit as per the line II—II on FIG. 1, but on a larger scale.
Figure 5:
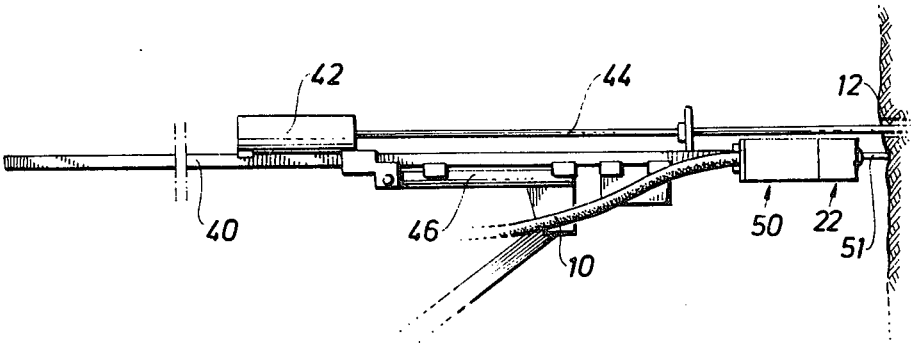
FIGS. 5 and 6 show in two different working positions, respectively, constituent parts of a combined drilling and charging machine made according to this invention.
Figure 6:
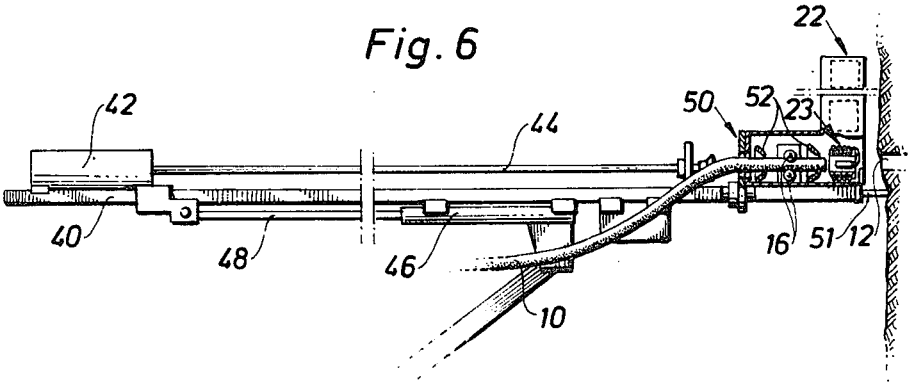

In FIGS. 5 and 6 a drilling unit 42 is placed on a stand 40 with its steel drill 44 in FIG. 5 shown in drilling position for the drilling of the shothole 12. When the shothole is completed the drilling machine is drawn back onto the stand as in FIG. 6 until the shothole is freely accessible. The drilling unit is operated by a servomotor represented by a pressure cylinder 46 and a piston 48. During the drilling operation a charging machine 50, which is similar to the mechanism shown in FIGS. 1-3, was swung to one side, but it is now moved up on a shaft 51 so that the end of the tube 10 is automatically centered opposite the hole 12 in the rock. The charging machine 50 includes driving devices 16 for the tube, which for the sake of simplicity are represented in FIG. 6 as two counterposed driving pulleys only. The machine also includes a pair of funnel-shaped guiding parts 52. Ahead of the end of the tube is an assembly consisting of a cord and a detonator as described above.

As the tube 10 is carried towards the bottom of the hole by the driving devices 16, the detonator 26 is propelled ahead of it while at the same time the cord 25 is unwound from the roll 24 in the assembly 23. When the detnator has reached the bottom, where it can be held in position by means of the guide 32, the tube 10 is withdrawn in a known manner, possibly by means of the driving devices 16, while the explosive is conveyed through the tube and gradually fills the hole 12.

Figure 7:
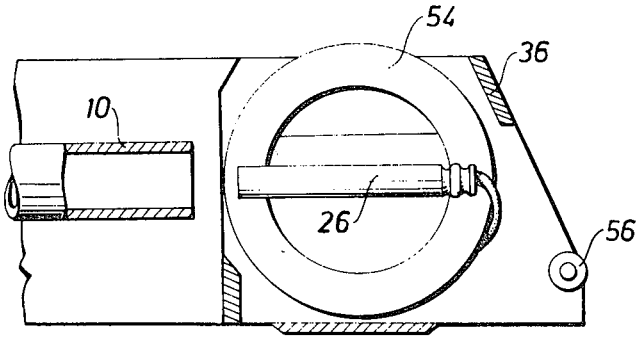
FIG. 7 shows part of a modified charging unit following an alternative method of inserting the detonator and cord.
Figure 8:
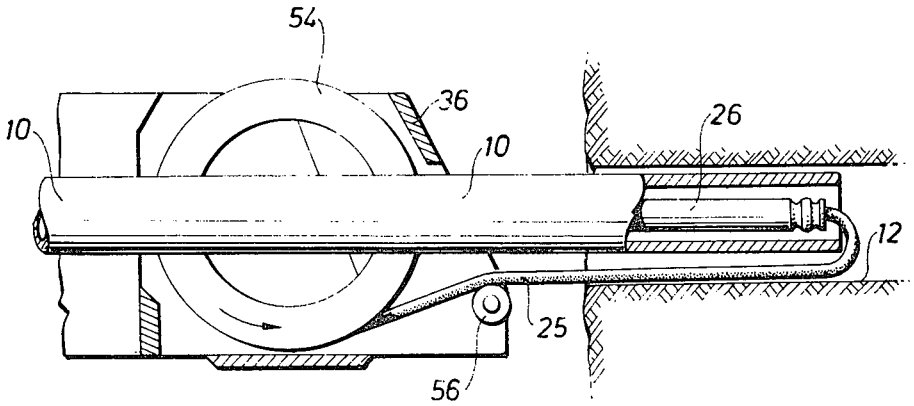
FIG. 8 shows the mutual positions of the parts of this modified unit after introduction of the detonator into the shothole has commenced.

The form of execution shown in FIGS. 7 and 8 differs from the preceding in that the cord 25 is wound on a roll 54 having a comparatively large diameter but a short length, whose axis lies at right angles to the center line of the tube 10 when in mounting position in the retainer 36. The detonator 26 is therefore mounted alongside the roll at right angles to the axis of the latter so that the detonator comes into the required position coaxially with the tube 10. As the detonator 26 is propelled into the hole 12 by the tube 10, the cord 25 is drawn along with the detonator and unwound from the roll, passing over a guide roll 56.

Figure 9:
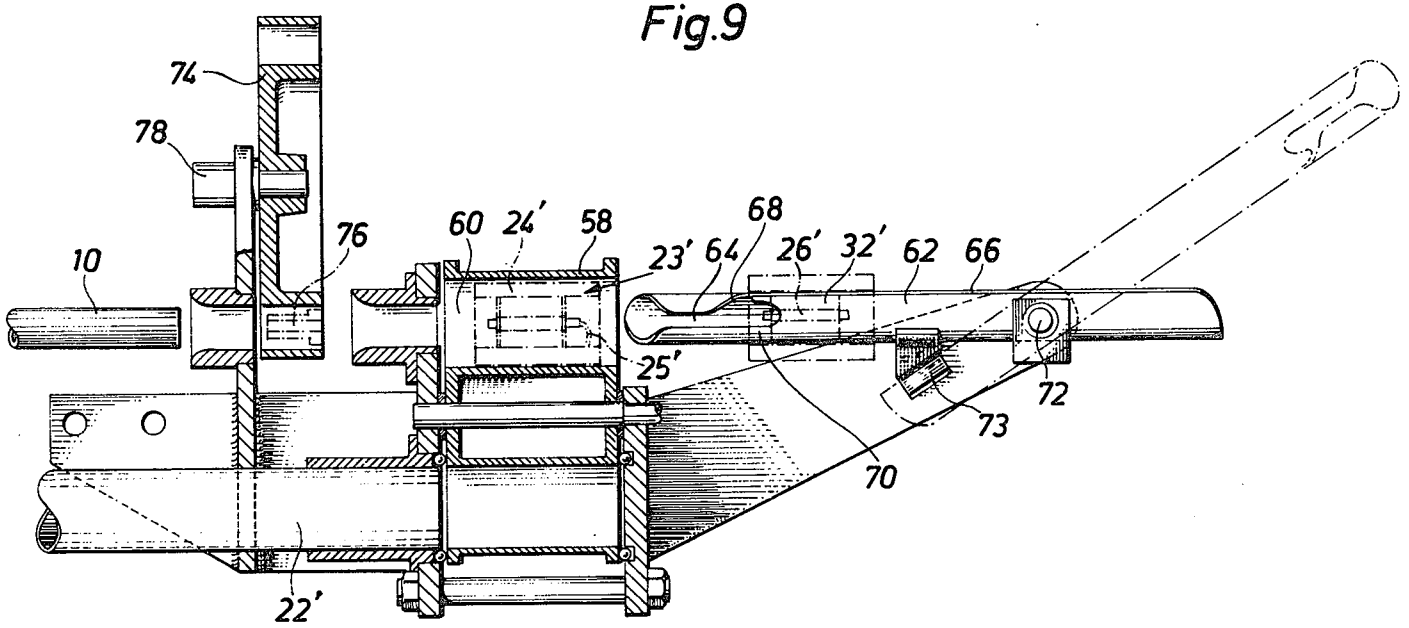
FIG. 9 shows, partly in section, still another modified form of this new charging machine.

The form of execution in FIG. 9 shows, in two different positions an assembly 23' (known), whose coil 24' can be unwound from the inside and which is set in its initial position ahead of the charging tube 10 by means of a revolving arrangement 58 equipped with, for example, four compartments 60 intended for assemblies 23' are loaded into the compartments 60 via a feed-in device 22', which may consist, for example, of a tube of a flexible material. The drawing shows an assembly 23' in place in a compartment 60. In front of the assembly 23', which is set in initial position, there is a guide pipe 62 having two parallel slots 64 and 66 running in the direction of the axis, which are joined by a connecting slot 68. When the assembly 23' is propelled forward by the charging tube 10, the coil 24' is brought to fit around the end portion 70 of the guide pipe 62, as shown, while the detonator 26' and its guide 32' are propelled into the pipe. The slots 64, 66 and 68 are shaped so that the cord 25', which is unwound from the inside of the coil 24', enters the guide pipe 62 at the inner end of the slot 64. As unwinding progresses, the roll 24' will move back and forth along the end portion 70 depending on the position of the coil being unwound at any given moment along the axis of the roll 24'. When the required length of cord 25' has been unwound into a shothole, and the shothole has been charged with an explosive, tube 10 is retracted, for example to the position shown in FIG. 9, and the guide pipe 62 can by swung around its pivot 72 into the position indicated in broken lines, whereupon the forward end of the pipe 62 will come in contact with a stop 73. After any remaining cord has been unwound, the roll can now be easily removed from the end portion 70 of the guide pipe 62.

FIG. 9 also shows a revolving arrangement 74 intended for a primer 76 which is sometimes necessary for the initiation of the explosive. The arrangement 74 is loaded in a known manner via a feed-in tube and is situated before the revolving arrangement 58 in the direction of feed. Thus, as the charging tube is thrust forward, it first propels the primer 76, which in turn propels the assembly 23' into the guide pipe 62. The primer, detonator, and cord are then introduced into the shothole by means of the charging tube 10 as it is fed through the guide pipe 62.

The invention is obviously not limited to the embodiments shown, but it can be varied in the widest sense within the terms of the concept which underlies it. Thus, in certain cases, the tube 10 can consist of the explosive itself if the latter is in the form of long sticks. Moreover, this application is intended to cover any such modifications as may fall within the scope of one skilled in the art or the appended claims.

I claim:

1. Apparatus for charging a shothole with explosive and a detonator, comprising a stand, an elongate, flexible charging tube mounted on said stand, means operable for inserting said tube into a shothole, a retainer mounted on said stand ahead of the front end of said tube, a roll of cord and a detonator assembly supported on said retainer coaxially of said tube, and with one end of said cord tied to said detonator, said roll having an internal diameter larger than the external diameter of said tube, and said detonator being centered in the bore in said roll and being positioned in the path of the tube, whereby the detonator is propelled by the tube as the latter is introduced into the shothole, while at the same time the cord is unwound from said roll, and a guiding device on said retainer operative to compel said roll to rotate about its own axis as it is unwound.

2. Apparatus as defined in claim 1 including a drilling unit mounted on said stand for drilling the shotholes, and means mounting the retainer and the forward end of the charging tube for pivotal movement on the stand into and out of charging positions in which they assume coaxial positions with respect to one another between said unit and the shothole that is to be charged.

3. Apparatus as defined in claim 1, including a supply duct connected to the retainer and operable for conveying the roll and detonator assemblies to the retainer.

4. Apparatus as defined in claim 1, wherein the retainer comprises a slotted guide pipe, and the roll rotates around the guide pipe and the cord is unwound from the bore in the roll and is drawn into the guide pipe through the slot during the insertion of said tube into a shothole.

5. Apparatus as defined in claim 4, including a revolving turret positioned between said tube and said guide pipe and being equipped with a number of compartments each disposed to hold a roll of cord and detonator assembly, and means mounting said turret for indexible rotation successively to move each compartment therein into an operative position in which it is centered opposite the charging tube whereby the detonator therein will be propelled ahead of the tube as the latter is fed into a shothole.

* * * * *